US008797219B2

(12) United States Patent
Ko et al.

(10) Patent No.: US 8,797,219 B2
(45) Date of Patent: Aug. 5, 2014

(54) INFINITE WAVELENGTH ANTENNA DEVICE

(75) Inventors: Jae Woo Ko, Uiwang-si (KR); Jeong Hae Lee, Seoul (KR); Joon Hyun Baek, Seoul (KR); Jae Hyun Park, Pyeongtaek-si (KR)

(73) Assignees: Samsung Electronics Co., Ltd., Suwon-si (KR); Hongik University Industry-Academia Cooperation Foundation, Seoul (KR)

( * ) Notice: Subject to any disclaimer, the term of this patent is extended or adjusted under 35 U.S.C. 154(b) by 504 days.

(21) Appl. No.: 13/142,937

(22) PCT Filed: Dec. 9, 2009

(86) PCT No.: PCT/KR2009/007342
§ 371 (c)(1),
(2), (4) Date: Aug. 30, 2011

(87) PCT Pub. No.: WO2010/076982
PCT Pub. Date: Jul. 8, 2010

(65) Prior Publication Data

US 2011/0304516 A1 Dec. 15, 2011

(30) Foreign Application Priority Data

Dec. 31, 2008 (KR) ..... 10-2008-0137669

(51) Int. Cl.
*H01Q 1/00* (2006.01)

(52) U.S. Cl.
USPC ..... 343/722

(58) Field of Classification Search
USPC ..... 343/700 MS, 722
See application file for complete search history.

(56) References Cited

U.S. PATENT DOCUMENTS 7,218,190 B2 * 5/2007 Engheta et al. ..... 333/239

FOREIGN PATENT DOCUMENTS

WO 2007/127955 A2 11/2007

OTHER PUBLICATIONS

Lai et al., Composite Right/Left-Handed Transmission Line Metamaterials, Microwave Magazine, IEEE, Sep. 2004, vol. 5, Issue 3, pp. 34-50.

Lai et al., Microwave Devices Based on Composite Right/Left-Handed Transmission Line Metamaterials, Antenna Theory: Small Antennas and Novel Materials, IWAT 2005, IEEE International Workshop, Mar. 2005, pp. 69-72.

* cited by examiner

*Primary Examiner* — Seung Lee
(74) *Attorney, Agent, or Firm* — Jefferson IP Law, LLP

(57) ABSTRACT

The present invention relates to an infinite wavelength antenna device, which includes: a board body made of a dielectric and having a slab structure; a feed part arranged on one surface of the board body, and generating a magnetic field when power is applied; and an MNG resonance part arranged on the board body so that a preset distance is maintained from the feed part and at least a portion thereof is placed within the magnetic field, grounded through both ends thereof, resonating at a specific frequency band when the magnetic field is generated, and having a negative permeability. In the present invention, as the infinite wavelength antenna device operates according to the infinite wavelength property, the resonant frequency band may be determined independently of the size of the antenna device. Hence, miniaturization of the infinite wavelength antenna device can be realized. In addition, as power feeding is performed using magnetic coupling in the infinite wavelength antenna device, power can be easily fed to multiple resonance parts of the antenna device. Consequently, the infinite wavelength antenna device may resonate at multiple frequency bands or a wider frequency band.

15 Claims, 11 Drawing Sheets

(a)

(b)

INFINITE WAVELENGTH ANTENNA DEVICE

TECHNICAL FIELD

The present invention relates to an antenna device and, more particularly, to an infinite wavelength antenna device.

BACKGROUND ART

In general, a communication terminal includes an antenna device to transmit and receive electromagnetic waves. Such an antenna device resonates at a specific frequency band to thereby transmit or receive electromagnetic waves of frequencies corresponding to the band. During resonance at the resonant frequency band, the antenna device has a complex impedance and the S parameter thereof rapidly decreases.

To achieve this, for a wavelength $\lambda$ corresponding to a desired frequency band, the antenna device includes a conducting wire having an electrical length of $\lambda/2$ and one end of the conducting wire is open or shorted. The antenna device transmits electromagnetic waves through the conducting wire and the electromagnetic waves form standing waves on the conducting wire, achieving resonance at the antenna device. Here, the antenna device may include multiple conducting wires of different lengths to extend the resonant frequency band.

DISCLOSURE OF INVENTION

Technical Problem

As described above, in an antenna device, the electrical length of a conducting wire is determined according to the resonant frequency band. That is, the size of the antenna device is determined according to the resonant frequency band. As the resonant frequency band becomes lower, the antenna device supporting the resonant frequency band has to become larger. This problem becomes more serious as the number of conducting wires in the antenna device increases. In other words, as the resonant frequency band is extended, the size of the antenna device increases.

Technical Solution

An aspect of the present invention is to provide an infinite wavelength antenna device including: a board body made of a dielectric and having a slab structure; a feed part arranged on one surface of the board body, and generating a magnetic field when power is applied; and an MNG resonance part arranged on the board body so that a preset distance is maintained from the feed part and at least a portion thereof is placed within the magnetic field, grounded through both ends thereof, resonating at a specific frequency band when the magnetic field is generated, and having a negative permeability.

Another aspect of the present invention is to provide an infinite wavelength antenna device including: a board body made of a dielectric and having a slab structure; a feed part formed as a bar extending in one direction on the upper surface of the board body, and generating a magnetic field when power is applied thereto; an MNG resonance part arranged on the upper surface of the board body so that a preset distance is maintained from the feed part and at least a portion thereof is placed within the magnetic field, having a transmission line in which a transmission gap of a given size is formed, having a transmission via formed at each of both ends of the transmission line and passing through the board body to extend from the upper surface thereof to the lower surface thereof, resonating at a specific frequency band when the magnetic field is generated, and having a negative permeability; and a ground part formed on the lower surface of the board body, connected with the transmission via, and grounding the MNG resonance part through the transmission via.

The MNG resonance part may be composed of multiple MNG resonance regions each of which is identified by one transmission gap and a fixed-length transmission line, and the MNG resonance regions may be connected in series so as to extend from one side of the feed part along the extension direction of the feed part.

The infinite wavelength antenna device may further include a second MNG resonance part arranged so that a preset distance is maintained from the MNG resonance part, and resonating, when the magnetic field is generated, at another frequency band.

Still another aspect of the present invention is to provide an infinite wavelength antenna device including: a board body made of a dielectric and having a slab structure; a feed part arranged on the upper surface of the board body, and generating a magnetic field when power is applied thereto; an ENG resonance part arranged on the upper surface of the board body so that a preset distance is maintained from the feed part and at least a portion thereof is placed within the magnetic field, resonating at a first frequency band when the magnetic field is generated, and having a negative permittivity; an MNG resonance part arranged on the lower surface of the board body so that a preset distance is maintained from the feed part and at least a portion thereof is placed within the magnetic field, resonating at a second frequency band different from the first frequency band when the magnetic field is generated, and having a negative permeability; and a ground part formed at one side of the MNG resonance part on the lower surface of the board body, and connected with one end of the feed part and one end of the ENG resonance part and further connected with both ends of the MNG resonance part to ground the feed part, the ENG resonance part and the MNG resonance part.

Advantageous Effects

In a feature of the present invention, as the infinite wavelength antenna device operates according to the infinite wavelength property, the frequency band for resonance may be determined independently of the size of the antenna device. Hence, the infinite wavelength antenna device may be miniaturized. In addition, as power feeding is performed using magnetic coupling in the infinite wavelength antenna device, power can be easily fed to multiple resonance parts of the infinite wavelength antenna device. Consequently, the infinite wavelength antenna device may resonate at multiple frequency bands or a wider frequency band.

BRIEF DESCRIPTION OF THE DRAWINGS

The objects, features and advantages of the present invention will be more apparent from the following detailed description in conjunction with the accompanying drawings, in which.

MODE FOR THE INVENTION

Hereinafter, exemplary embodiments of the present invention are described in detail with reference to the accompanying drawings. The same reference symbols are used throughout the drawings to refer to the same or like parts. Detailed descriptions of well-known functions and structures incorporated herein may be omitted to avoid obscuring the subject matter of the present invention.

Figure 1:
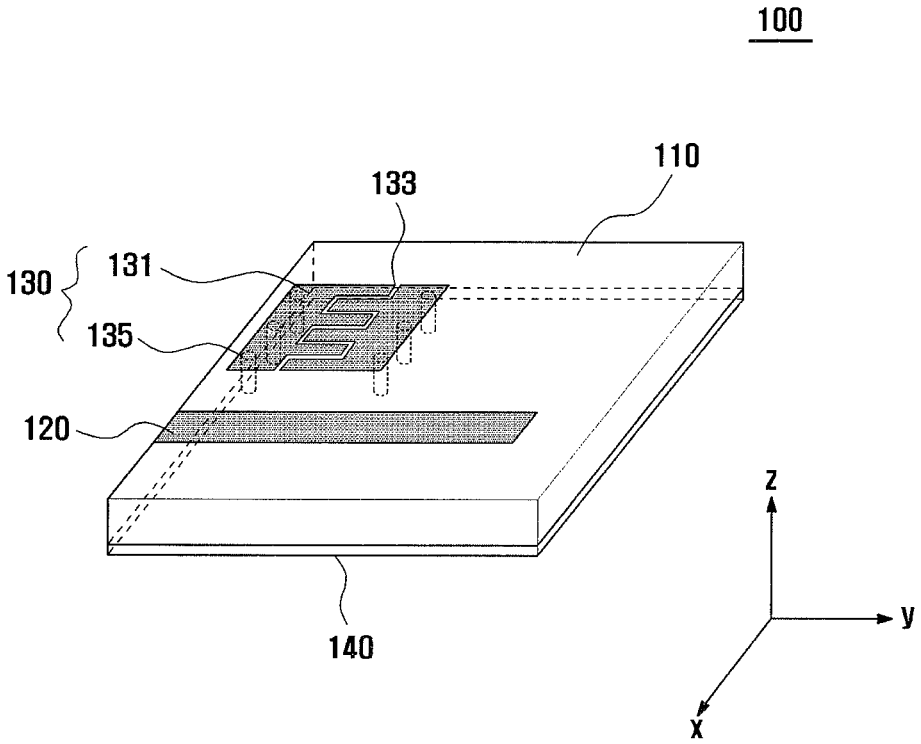
FIG. 1 is a perspective view of an infinite wavelength antenna device according to a first embodiment of the present invention.

FIG. 1 is a perspective view of an infinite wavelength antenna device 100 according to a first embodiment of the present invention. In the description of the present embodiment, the infinite wavelength antenna device is assumed to be realized using a printed circuit board (PCB).

Referring to FIG. 1, the infinite wavelength antenna device 100 includes a board body 110, a feed part 120, a mu negative (MNG) resonance part 130 and a ground part 140.

The board body 110 acts as a support body for the infinite wavelength antenna device 100. The board body 110 takes a form of a slab and is composed of an insulating dielectric.

The feed part 120 is used for power feed to the infinite wavelength antenna device 100. The feed part 120 is formed on the upper surface of the board body 110. Here, the feed part 120 may be formed through patterning of a metallic material on the surface of the board body 110. The feed part 120 may be provided to the infinite wavelength antenna device 100 in the form of a microstrip line, a probe, a coplanar waveguide or the like. The feed part 120 is formed as a bar extending in one direction. The feed part 120 may be extended so as to pass through the central portion of the upper surface of the board body 110 or may be extended close to the edge portion thereof. Power may be applied through one end of the feed part 120 and the other end thereof may be open. When power is applied, the feed part 120 generates a magnetic field in the vicinity of, within a given distance from, the feed part 120 in the board body 110.

The MNG resonance part 130 performs actual transmission and reception of electromagnetic waves in the infinite wavelength antenna device 100. The MNG resonance part 130 is formed on the upper surface of the board body 110. Here, the MNG resonance part 130 may be formed through patterning of a magnetic metallic material on the surface of the board body 110. The MNG resonance part 130 is arranged so that a preset distance is maintained from the feed part 120. Here, the MNG resonance part 130 is arranged so that at least a portion thereof is placed within the magnetic field generated by the feed part 120. As such, when a magnetic field is generated by the feed part 120, the MNG resonance part 130 and the feed part 120 enter into an excited state. That is, magnetic coupling is achieved between the MNG resonance part 130 and the feed part 120, and the feed part 120 supplies power to the MNG resonance part 130. Thereby, when power is supplied, the MNG resonance part 130 resonates at a specific frequency band.

In addition, the MNG resonance part 130 is configured to have a negative permeability ($\mu \leq 0$) and a positive permittivity ($\in > 0$). Here, the MNG resonance part 130 is realized as a zeroth order mode resonator (ZOR). That is, the MNG resonance part 130 resonates at a frequency band at which the phase constant ($\beta$) of the electromagnetic wave becomes 0. In other words, the MNG resonance part 130 exhibits the infinite wavelength property. Additionally, the MNG resonance part 130 is composed of a single unit cell (1×1 configuration). The MNG resonance part 130 includes a transmission line 131 and a transmission via 135.

The transmission line 131 includes a transmission gap 133 of a given size. Here, the transmission line 131 may be configured to have a plurality of bent portions. The transmission line 131 may be formed to have at least one of a meander type, a spiral type, a step type and a loop type. Or, the transmission gap 133 may be configured to have a plurality of bent portions. The transmission gap 133 may be formed to have at least one of a meander type, a spiral type, a step type and a loop type. The transmission line 131 extends from one side of the feed part 120 in one direction along the extension direction of the feed part 120 so that the transmission line 131 is located within the magnetic field of the feed part 120. The transmission via 135 is formed at each of both ends of the transmission line 131, and passes through the board body 110 from the upper surface thereof to the lower surface thereof. The transmission via 135 is formed as a through hole filled with a metallic material.

Figure 2:
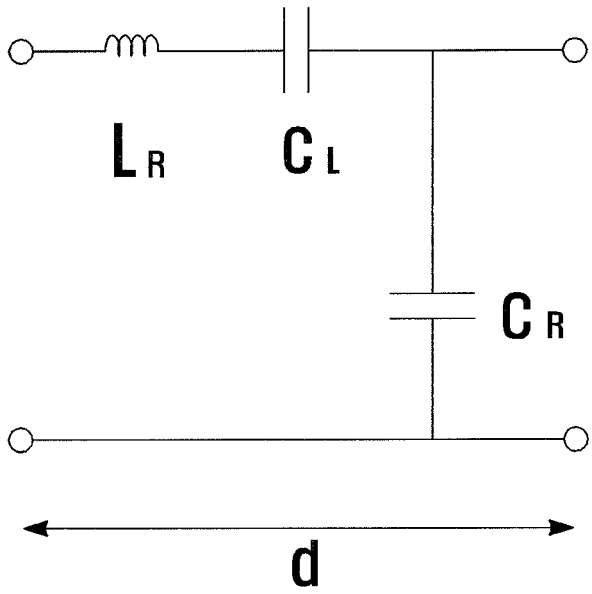
FIG. 2 shows an equivalent circuit of an MNG resonance part in the antenna device of FIG. 1.

For resonance at a specified frequency band, the MNG resonance part 130 is designed to have unique inductance and capacitance. This is described in connection with FIG. 2. FIG. 2 shows an equivalent circuit of the MNG resonance part 130 in the antenna device of FIG. 1.

Referring to FIG. 2, the equivalent circuit of the MNG resonance part 130 in the infinite wavelength antenna device 100 is composed of a series inductor $L_R$, a series capacitor $C_L$ and a parallel capacitor $C_R$. The series inductor $L_R$ is connected in series with the series capacitor $C_L$ and the parallel capacitor $C_R$ is connected in parallel with the series inductor $L_R$ and the series capacitor $C_L$. That is, the series inductor $L_R$ and the parallel capacitor $C_R$ are arranged in a normal right handed (RH) configuration where the propagation direction of the electric field, magnetic field and electromagnetic wave follows the right-hand rule. Negative permeability is determined by series connection between the series inductor $L_R$ and the series capacitor $C_L$.

The permeability μ and permittivity ∈ of the MNG resonance part 130 are determined by Equation 1. The permeability of the MNG resonance part 130 becomes negative under the condition given by Equation 2. The frequency band at which the MNG resonance part 130 resonates and exhibits the infinite wavelength property in the infinite wavelength antenna device 100 is determined by Equation 3.

$$\mu = \frac{Z}{jw} = L_R - \frac{1}{w^2 C_L}, \quad \varepsilon = \frac{Y}{jw} = C_R \qquad \text{<Equation 1>}$$

$$\frac{1}{w^2 C_L} > L_R, \quad w < \left(\frac{1}{L_R C_L}\right)^{1/2} \qquad \text{<Equation 2>}$$

$$w = \left(\frac{1}{L_R C_L}\right)^{1/2} \qquad \text{<Equation 3>}$$

In the infinite wavelength antenna device 100, the size or configuration of the MNG resonance part 130 determines characteristics of the corresponding equivalent circuit. For example, the inductance of the MNG resonance part 130 is determined according to the size (i.e., length and width) of the transmission line 131 in the MNG resonance part 130. The capacitance of the MNG resonance part 130 is determined according to the size (i.e., length and width) of the transmission gap 133 in the MNG resonance part 130. Here, when the transmission gap 133 is configured to have a plurality of bent portions, the capacitance of the MNG resonance part 130 may be determined. The distance between the feed part 120 and the MNG resonance part 130 is determined so that impedance matching is achieved in a desired level at the MNG resonance part 130.

The ground part 140 is used to ground the infinite wavelength antenna device 100. The ground part 140 is formed at the lower surface of the board body 110. Here, the ground part 140 may be formed to cover the lower surface of the board body 110. The ground part 140 contacts both ends of the MNG resonance part 130 to thereby ground the MNG resonance part 130. That is, the ground part 140 may ground the MNG resonance part 130 through the transmission via 135 of the MNG resonance part 130 on the lower surface of the board body 110.

Figure 3:
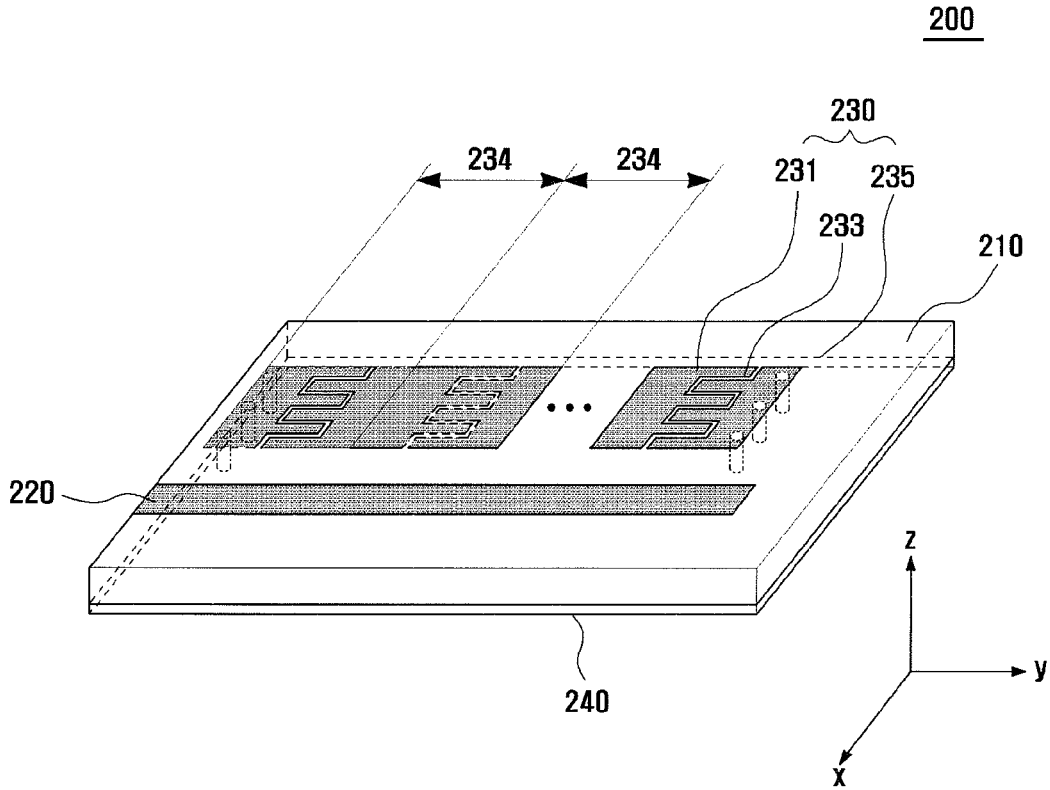
FIG. 3 is a perspective view of an infinite wavelength antenna device according to a second embodiment of the present invention.

In the above-described embodiment, the MNG resonance part is composed of a single unit cell. However, the present invention is not limited thereto. That is, the MNG resonance part may be composed of multiple unit cells. By adjusting the number of unit cells in an infinite wavelength antenna device, it is possible to regulate the fractional bandwidth for the resonant bandwidth, the gain and operating efficiency of the infinite wavelength antenna device. For example, in the MNG resonance part, unit cells may be arranged in 1×2, 1×3, . . . , 1×k configurations. This is described as another embodiment. FIG. 3 is a perspective view of an infinite wavelength antenna device 200 according to a second embodiment of the present invention. Here, the infinite wavelength antenna device is assumed to be realized using a printed circuit board.

Referring to FIG. 3, the infinite wavelength antenna device 200 includes a board body 210, a feed part 220, an MNG resonance part 230 and a ground part 240. The basic configuration of the infinite wavelength antenna device 200 is similar to that of the previous embodiment, and a detailed description thereof is thus omitted.

In the present embodiment, the MNG resonance part 230 is composed of multiple unit cells. In the MNG resonance part 230, the transmission line 231 includes multiple transmission gaps 233 formed at regular intervals. The MNG resonance part 230 is divided into multiple MNG resonance regions 234 corresponding respectively to multiple unit cells. Here, one MNG resonance region 234 indicates a fixed-length portion of the transmission line 231 including one transmission gap 233. That is, the MNG resonance part 230 may be viewed as a structure composed of the MNG resonance regions 234 connected in series. The MNG resonance regions 234 are connected in series, extending from one side of the feed part 220 along the extension direction of the feed part 220, so that the MNG resonance regions 234 are placed within the magnetic field of the feed part 220. In the MNG resonance part 230, the transmission vias 235 are formed at the MNG resonance regions 234 corresponding to both ends of the MNG resonance part 230. Thereby, when power is applied, the MNG resonance part 230 resonates at multiple frequency bands.

As the MNG resonance regions 234 have the same size and configuration and are interconnected in a periodic structure to form the MNG resonance part 230, the MNG resonance part 230 may resonate at multiple regularly arranged frequency bands. For example, when the MNG resonance part 230 includes three unit cells each of which resonates at about 2 GHz, the MNG resonance part 230 may resonate at about 2 GHz, 4 GHz and 6 GHz.

Figure 4:
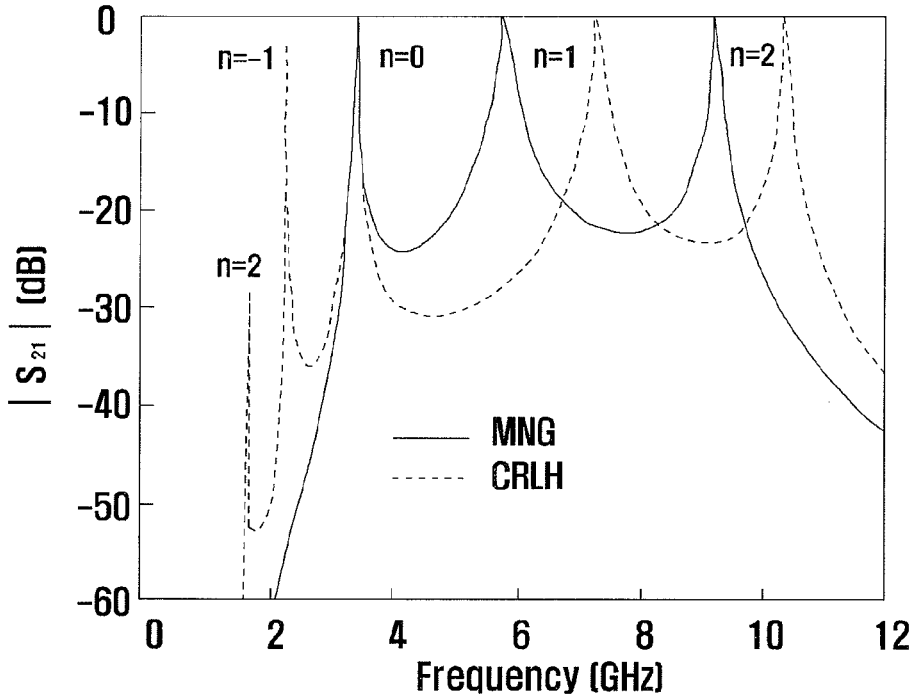
FIG. 4 illustrates resonance characteristics of the antenna device of FIG. 3.

Hence, the infinite wavelength antenna device 200 is realized as a zeroth order mode resonator. This is described in connection with FIG. 4. FIG. 4 illustrates resonance characteristics of the antenna device of FIG. 3.

As shown in FIG. 4, the infinite wavelength antenna device 200 may produce zeroth order (n=0) resonance. That is, like a composite right/left handed (CRLH) metamaterial resonator, the MNG resonance part 230 of the infinite wavelength antenna device 200 may produce zeroth order resonance. In other words, the MNG resonance part 230 exhibits the infinite wavelength property.

Here, metamaterials indicate artificial materials or structures engineered to have electromagnetic properties that cannot be easily found in nature. A metamaterial may have a negative permittivity (∈<0) and a negative permeability (μ<0) under certain conditions and exhibit different propagation properties for electromagnetic waves than a normal material. In other words, a metamaterial configuration uses reversal of electromagnetic wave phase velocity and may be realized using CRLH resonators. A CRLH configuration is a combination of a right handed (RH) configuration in which the propagation direction of the electric field, magnetic field and electromagnetic wave follows Fleming's right-hand rule, and a left handed (LH) configuration in which the propagation direction of the electric field, magnetic field and electromagnetic wave follows Fleming's left-hand rule. In such a metamaterial configuration, the phase constant and the frequency band of an electromagnetic wave are non-linearly related.

According to the previous embodiments, as the infinite wavelength antenna device has the infinite wavelength property, it may operate above a certain level of operating characteristics regardless of the number of unit cells in the MNG resonance part. For example, operating characteristics of the infinite wavelength antenna device with respect to the number of unit cells in the MNG resonance part are illustrated in Table 1.

TABLE 1

| | Number of unit cells | | |
|---|---|---|---|
| | 1 × 1 | 1 × 2 | 1 × 3 |
| Size of MNG resonance part | 0.020 $\lambda_0$ × 0.066 $\lambda_0$ | 0.022 $\lambda_0$ × 0.146 $\lambda_0$ | 0.022 $\lambda_0$ × 0.224 $\lambda_0$ |
| Resonant frequency band | 6.6 GHz | 7.3 GHz | 7.46 GHz |
| 10 dB fractional bandwidth | 1.4% | 2.8% | 3.3% |
| Gain | 2.3 dBi | 2.9 dBi | 3.9 dBi |
| Operating efficiency | 84% | 90% | 92% |

As the number of unit cells in the MNG resonance part increases, the 10 dB fractional bandwidth for the resonant frequency band, gain and operating efficiency increase. Here, when the infinite wavelength antenna device is driven, because the electric field generated by the transmission gap of the MNG resonance part weakens the magnetic field in the vicinity of the transmission gap, loss is reduced in the MNG resonance part, increasing the operating efficiency of the infinite wavelength antenna device. However, as the number of unit cells increases in the infinite wavelength antenna device, the size of the MNG resonance part increases. Hence, it is possible to provide an infinite wavelength antenna device having optimal operating characteristics by adjusting the number of unit cells in the infinite wavelength antenna device.

Figure 5:
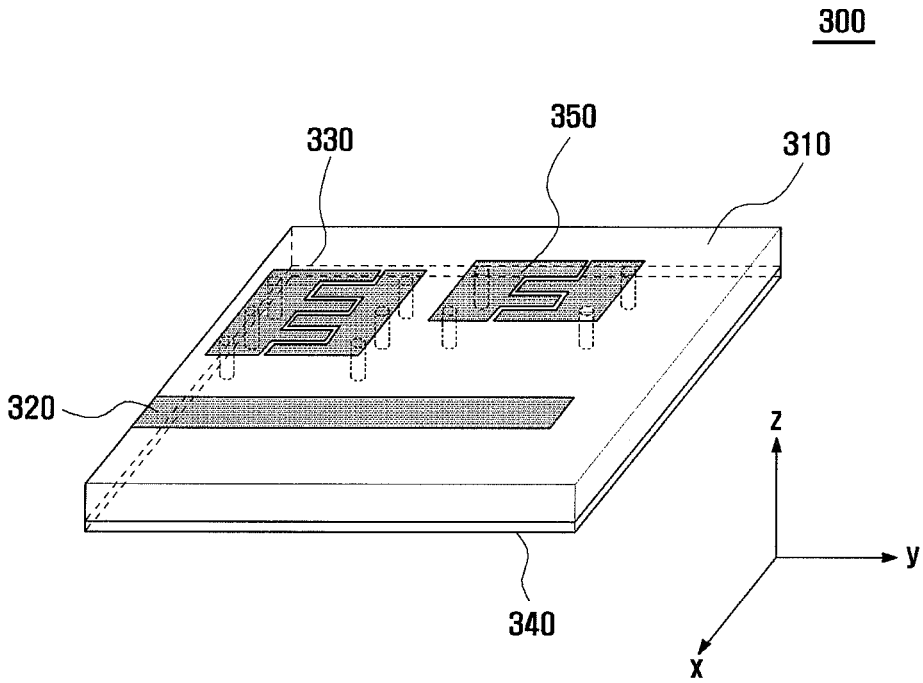
FIG. 5 is a perspective view of an infinite wavelength antenna device according to a third embodiment of the present invention.

In the above-described embodiments, the infinite wavelength antenna device includes a single MNG resonance part. However, the present invention is not limited thereto. That is, the infinite wavelength antenna device may include multiple MNG resonance parts. By adjusting the number of MNG resonance parts, it is possible to control the fractional bandwidth for the resonant frequency band, gain and operating efficiency of the infinite wavelength antenna device. For example, MNG resonance parts may be arranged in 1×2, 1×3, . . . , 1×k configurations. This is described as another embodiment. FIG. 5 is a perspective view of an infinite wavelength antenna device 300 according to a third embodiment of the present invention. Here, the infinite wavelength antenna device is assumed to be realized using a printed circuit board. The infinite wavelength antenna device is also assumed to have two MNG resonance parts.

Referring to FIG. 5, the infinite wavelength antenna device 300 includes a board body 310, a feed part 320, a first MNG resonance part 330 and a ground part 340, and further includes a second MNG resonance part 350. The basic configuration of the infinite wavelength antenna device 300 is similar to that of the previous embodiment, and a detailed description thereof is thus omitted.

In the present embodiment, the infinite wavelength antenna device 300 includes the first MNG resonance part 330 and second MNG resonance part 350 which are independent of each other. The first MNG resonance part 330 and the second MNG resonance part 350 are separated from each other. The first MNG resonance part 330 and the second MNG resonance part 350 may have different sizes and configurations. The first MNG resonance part 330 and the second MNG resonance part 350 may be located at one of both sides of the feed part 320 so that they are placed within the magnetic field of the feed part 320. Here, the first MNG resonance part 330 and the second MNG resonance part 350 may be separately arranged in a row at the same side of the feed part 320 along the extension direction of the feed part 320. The first MNG resonance part 330 and the second MNG resonance part 350 may also be arranged at different sides of the feed part 320. The first MNG resonance part 330 and the second MNG resonance part 350 are separately grounded to the ground part 340. Thereby, the first MNG resonance part 330 and the second MNG resonance part 350 resonate at different frequency bands. That is, the infinite wavelength antenna device 300 resonates at multiple frequency bands.

Here, as the first MNG resonance part 330 and second MNG resonance part 350 having different sizes or configurations are separately arranged, the infinite wavelength antenna device 300 may resonate at multiple irregularly arranged frequency bands. For example, the first MNG resonance part 330 and the second MNG resonance part 350 may be implemented so as to respectively resonate at about 2 Ghz and about 5 Ghz. Although the first MNG resonance part 330 and the second MNG resonance part 350 may have different sizes or configurations, similar levels of impedance matching can be set for the first MNG resonance part 330 and the second MNG resonance part 350. This can be achieved by adjusting both the distance between the feed part 320 and the first MNG resonance part 330 and the distance between the feed part 320 and the second MNG resonance part 350.

According to the present embodiment, in the infinite wavelength antenna device, as each MNG resonance part has the infinite wavelength property, it may operate above a certain level of operating characteristics. For example, operating characteristics of each MNG resonance part in the infinite wavelength antenna device may be illustrated as in Table 2.

TABLE 2

| | First MNG resonance part | Second MNG resonance part |
|---|---|---|
| Resonant frequency band | 6.2 GHz | 7 GHz |
| 10 dB fractional bandwidth | 1% | 1% |
| Gain | 2.4 dBi | 3.3 dBi |
| Operating efficiency | 90% | 84% |

By increasing the number of MNG resonance parts in the infinite wavelength antenna device, it is possible to increase the number of resonant frequency bands and extend the 10 dB fractional bandwidth for the resonant frequency bands. Hence, it is possible to provide an infinite wavelength antenna device having optimal operating characteristics by adjusting the number of MNG resonance parts in the infinite wavelength antenna device.

Figure 6:
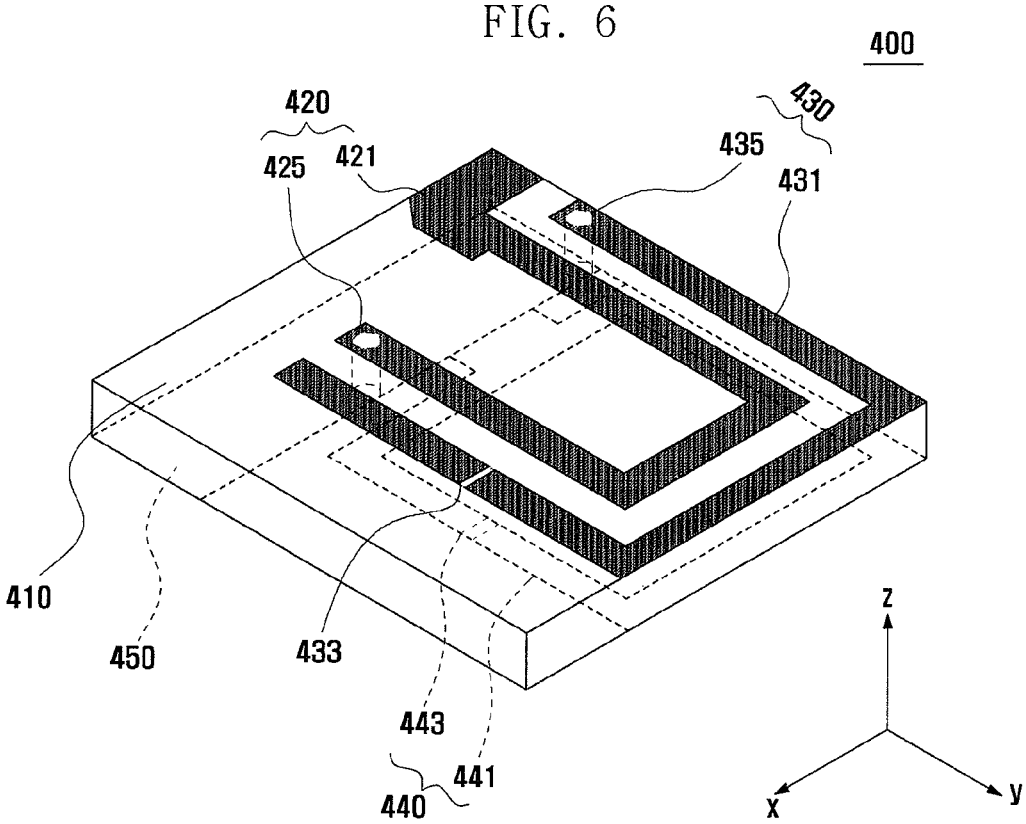
FIG. 6 is a perspective view of an infinite wavelength antenna device according to a fourth embodiment of the present invention.
Figure 6:
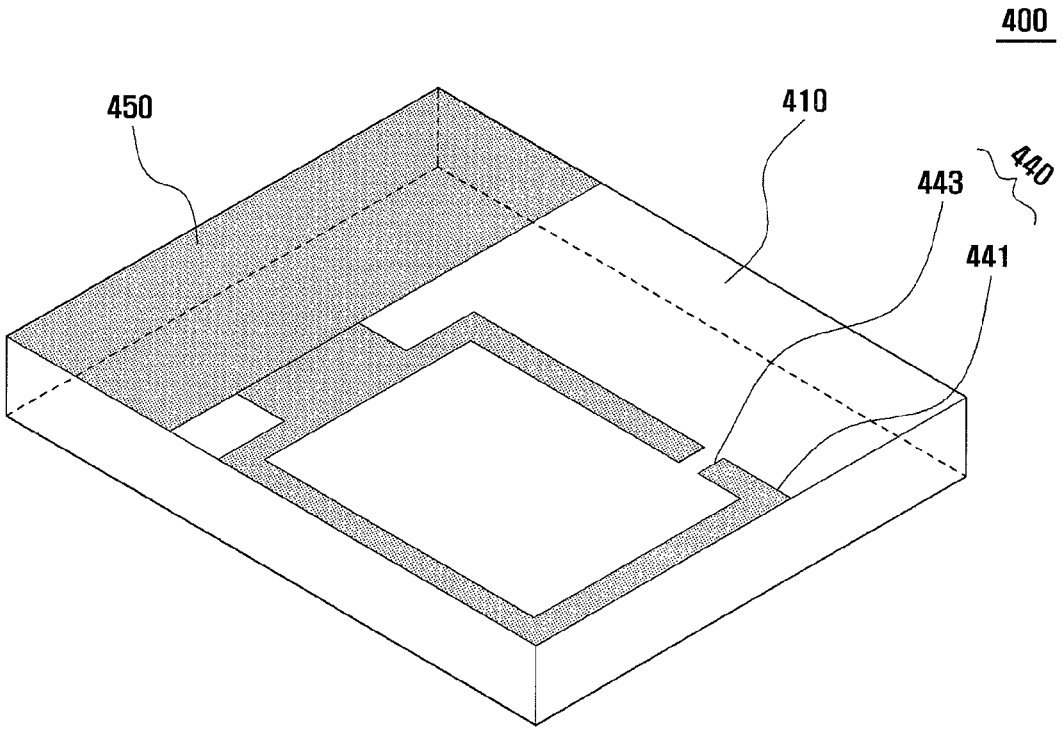

In the previous embodiments, the infinite wavelength antenna device includes at least one MNG resonance part and resonance is achieved by the MNG resonance part. However, the present invention is not limited thereto. That is, in addition to the MNG resonance part, the infinite wavelength antenna device may further include a resonance means resonating at a specific frequency band. This is described as another embodiment. FIG. 6 is a perspective view of an infinite wavelength antenna device 400 according to a fourth embodiment of the present invention. In FIG. 6, (*a*) indicates a top perspective view of the infinite wavelength antenna device 400 and (*b*) indicates a bottom perspective view of the infinite wavelength antenna device 400. Here, the infinite wavelength antenna device is assumed to be realized using a printed circuit board.

Referring to FIG. 6, the infinite wavelength antenna device 400 includes a board body 410, a feed part 420, an epsilon negative (ENG) resonance part 430, an MNG resonance part 440, and a ground part 450.

The board body 410 acts as a support body for the infinite wavelength antenna device 400. The board body 410 takes the form of a slab and is composed of an insulating dielectric.

The feed part 420 serves to feed power to the infinite wavelength antenna device 400. The feed part 420 is formed on the upper surface of the board body 410. Here, the feed part 420 may be formed through patterning of a metallic material on the surface of the board body 410. The feed part 420 may be provided to the infinite wavelength antenna device 400 in the form of a microstrip line, a probe, a coplanar waveguide or the like. The feed part 420 may be extended so as to pass through the central portion of the upper surface of the board body 410 or may be extended close to the edge portion thereof. Power may be applied through one end of the feed part 420. When power is applied, the feed part 420 generates a magnetic field in the vicinity of, within a given distance from, the feed part 420 in the board body 410. The feed part 420 includes a feed line 421 and a feed via 425.

The feed line 421 may be configured to have a plurality of bent portions. The feed line 421 may be formed to have at least one of a meander type, a spiral type, a step type and a loop type. Power is applied through one end of the feed line 421. The feed via 425 is formed at the other end of the feed line 421, and passes through the board body 410 from the upper surface thereof to the lower surface thereof. The feed via 425 is formed as a through hole filled with a metallic material.

The ENG resonance part 430 performs actual transmission and reception of electromagnetic waves in the infinite wavelength antenna device 400. The ENG resonance part 430 is formed on the upper surface of the board body 410. Here, the ENG resonance part 430 may be formed through patterning of a magnetic metallic material on the surface of the board body 410. The ENG resonance part 430 is arranged so that a preset distance is maintained from the feed part 420. Here, the ENG resonance part 430 is arranged so that at least a portion thereof is placed within the magnetic field generated by the feed part 420. As such, when a magnetic field is generated by the feed part 420, the ENG resonance part 430 and the feed part 420 enter into an excited state. That is, magnetic coupling is achieved between the ENG resonance part 430 and the feed part 420, and the feed part 420 supplies power to the ENG resonance part 430. Thereby, when power is supplied, the ENG resonance part 430 resonates at a first frequency band.

In addition, the ENG resonance part 430 is configured to have a negative permittivity ($\in \leq 0$) and a positive permeability ($\mu > 0$). Here, the ENG resonance part 430 is realized as a zeroth order mode resonator. That is, the ENG resonance part 430 resonates at the first frequency band where the phase constant of the electromagnetic wave becomes 0. In other words, the ENG resonance part 430 exhibits the infinite wavelength property. The ENG resonance part 430 includes an ENG transmission line 431 and an ENG transmission via 435.

The ENG transmission line 431 includes an ENG transmission gap 433 of a given size. The ENG transmission line 431 may be configured to have a plurality of bent portions. The ENG transmission line 431 may be formed to have at least one of a meander type, a spiral type, a step type and a loop type. Or, the ENG transmission gap 433 may be configured to have a plurality of bent portions. The ENG transmission gap 433 may be formed to have at least one of a meander type, a spiral type, a step type and a loop type. The ENG transmission line 431 extends from one side of the feed part 420 in one direction along the extension direction of the feed part 420 so that the ENG transmission line 431 is located within the magnetic field of the feed part 420. The ENG transmission via 435 is formed at one end of the ENG transmission line 431, and passes through the board body 410 from the upper surface thereof to the lower surface thereof. The ENG transmission via 435 is formed as a through hole filled with a metallic material. One end of the ENG transmission line 431 is connected with the ENG transmission via 435 and the other end thereof is open.

Figure 7:
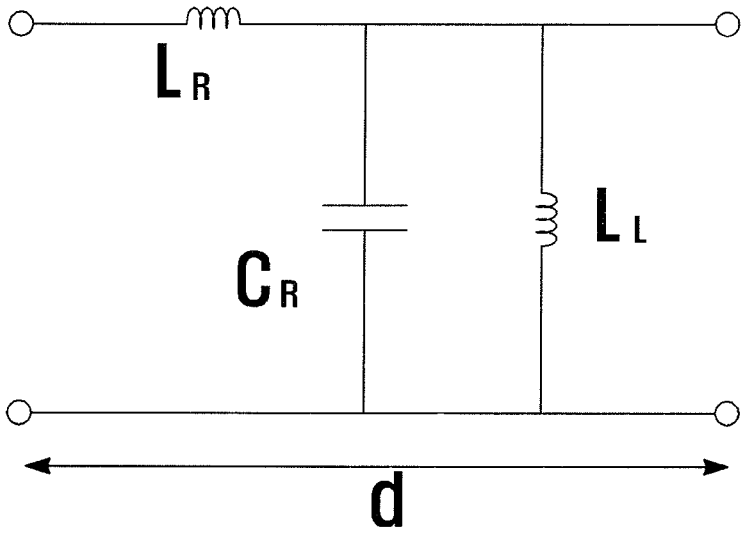
FIG. 7 shows an equivalent circuit of an ENG resonance part in the antenna device of FIG. 6.

For resonance at the first frequency band, the ENG resonance part 430 is designed to have unique inductance and capacitance. This is described in connection with FIG. 7. FIG. 7 shows an equivalent circuit of the ENG resonance part 430 in FIG. 6.

Referring to FIG. 7, the equivalent circuit of the ENG resonance part 430 in the infinite wavelength antenna device 400 is composed of a series inductor $L_R$, a parallel capacitor $C_R$ and a parallel inductor $L_L$. The series inductor $L_R$, parallel capacitor $C_R$ and parallel inductor $L_L$ are interconnected in parallel. That is, the series inductor $L_R$ and the parallel capacitor $C_R$ are arranged in a normal right handed (RH) configuration where the propagation direction of the electric field, magnetic field and electromagnetic wave follow the right-hand rule. Negative permittivity is determined by parallel connection between the parallel capacitor $C_R$ and the parallel inductor $L_L$.

The permeability $\mu$ and permittivity $\in$ of the ENG resonance part 430 are determined by Equation 4. The permittivity of the ENG resonance part 430 becomes negative under the conditions given by Equation 5. The frequency band at which the ENG resonance part 430 resonates and exhibits the infinite wavelength property in the infinite wavelength antenna device 400 is determined by Equation 6.

$$\mu = \frac{Z}{jw} = L_R, \quad \varepsilon = \frac{Y}{jw} = C_R - \frac{1}{w^2 L_L} \qquad \text{<Equation 4>}$$

$$\frac{1}{w^2 L_L} > C_R, \quad w < \left(\frac{1}{C_R L_L}\right)^{1/2} \qquad \text{<Equation 5>}$$

$$w = \left(\frac{1}{C_R L_L}\right)^{1/2} \qquad \text{<Equation 6>}$$

In the infinite wavelength antenna device 400, the size or configuration of the ENG resonance part 430 determines characteristics of the corresponding equivalent circuit. For example, the inductance of the ENG resonance part 430 is determined according to the size (i.e., length and width) of the ENG transmission line 431 in the ENG resonance part 430. The inductance of the ENG resonance part 430 may be determined according to the location of the ENG transmission gap 433 in the ENG transmission line 431. That is, the inductance of the ENG resonance part 430 may be determined according to the size of the ENG transmission line 431 between one end (i.e., ENG transmission via 435) and the ENG transmission gap 433 and to the size of the ENG transmission line 431 between the ENG transmission gap 433 and the other open end. The capacitance of the ENG resonance part 430 is determined according to the size (i.e., length and width) of the ENG transmission gap 433 in the ENG resonance part 430. The distance between the feed part 420 and the ENG resonance part 430 is determined so that impedance matching is achieved in a desired level at the ENG resonance part 430.

The MNG resonance part 440 performs actual transmission and reception of electromagnetic waves in the infinite wavelength antenna device 400. The MNG resonance part 440 is formed on the lower surface of the board body 410. Here, the MNG resonance part 440 may be formed through patterning of a magnetic metallic material on the surface of the board body 410. The MNG resonance part 440 is arranged so that at least a portion thereof is placed within the magnetic field generated by the feed part 420. As such, when a magnetic field is generated by the feed part 420, the MNG resonance part 440 and the feed part 420 enter into an excited state. That is, magnetic coupling is achieved between the MNG resonance part 440 and the feed part 420, and the feed part 420 supplies power to the MNG resonance part 440. Thereby, when power is supplied, the MNG resonance part 440 resonates at a second frequency band.

In addition, the MNG resonance part 440 is configured to have a negative permeability and a positive permittivity. Here, the MNG resonance part 440 is realized as a zeroth order mode resonator. That is, the MNG resonance part 440 resonates at a frequency band where the phase constant of the electromagnetic wave becomes 0. In other words, the MNG resonance part 440 exhibits the infinite wavelength property. The MNG resonance part 440 includes an MNG transmission line 441.

The MNG transmission line 441 includes an MNG transmission gap 443 of a given size. The MNG transmission line 441 may be configured to have a plurality of bent portions. The MNG transmission line 441 may be formed to have at least one of a meander type, a spiral type, a step type and a loop type. Or, the MNG transmission gap 443 may be configured to have a plurality of bent portions. The MNG transmission gap 443 may be formed to have at least one of a meander type, a spiral type, a step type and a loop type. The MNG transmission line 441 extends along the extension direction of the feed part 420 on the lower surface of the board body 410 so that the MNG transmission line 441 is located within the magnetic field of the feed part 420.

For resonance at the second frequency band, the MNG resonance part 440 is designed to have unique inductance and capacitance. This is the same as described in connection with FIG. 2, and is not detailed further.

The ground part 450 is used for grounding of the infinite wavelength antenna device 400. The ground part 450 is formed at the lower surface of the board body 410. The ground part 450 may be formed close to both ends of the MNG resonance part 440 or contacts both ends of the MNG resonance part 440 to thereby ground the MNG resonance part 440. The ground part 450 contacts one end of the feed part 420 and one end of the ENG resonance part 430 on the lower surface of the board body 410 to thereby ground the feed part 420 and the ENG resonance part 430. That is, the ground part 450 may ground the feed part 420 and the ENG resonance part 430 on the lower surface of the board body 410 using the feed via 425 of the feed part 420 and the ENG transmission via 435 of the ENG resonance part 430.

Figure 8:
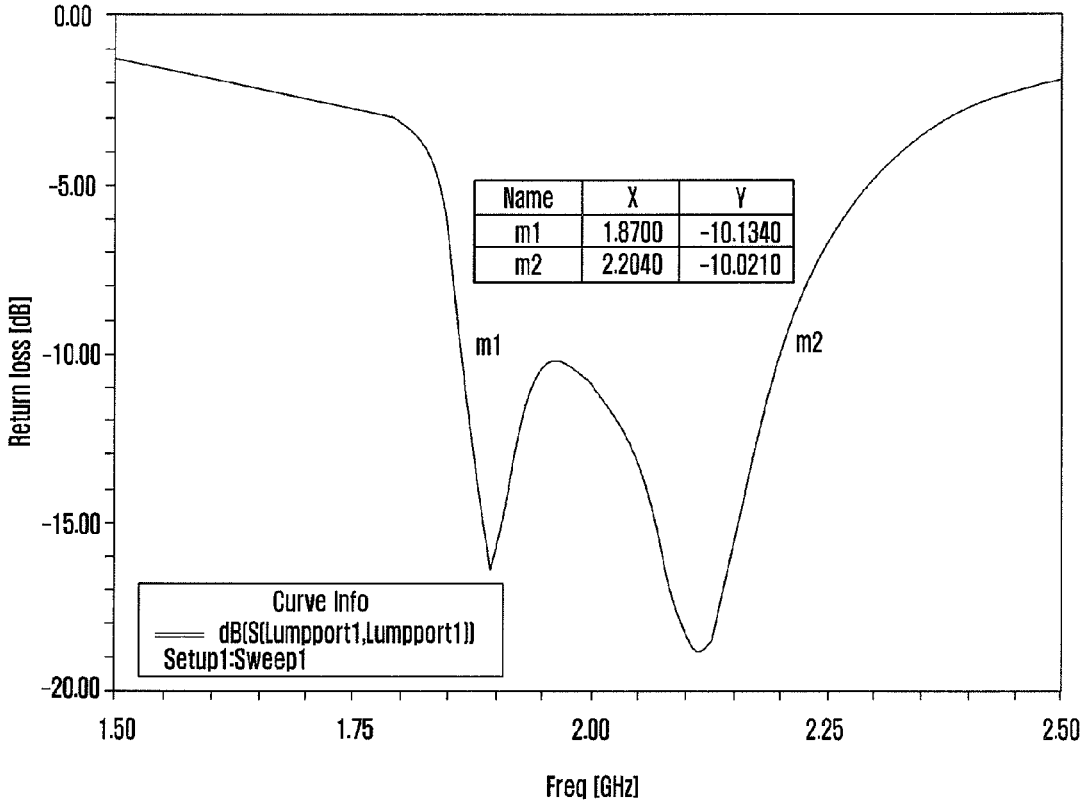
FIG. 8 depicts resonance characteristics of the antenna device of FIG. 6.
Figure 9:
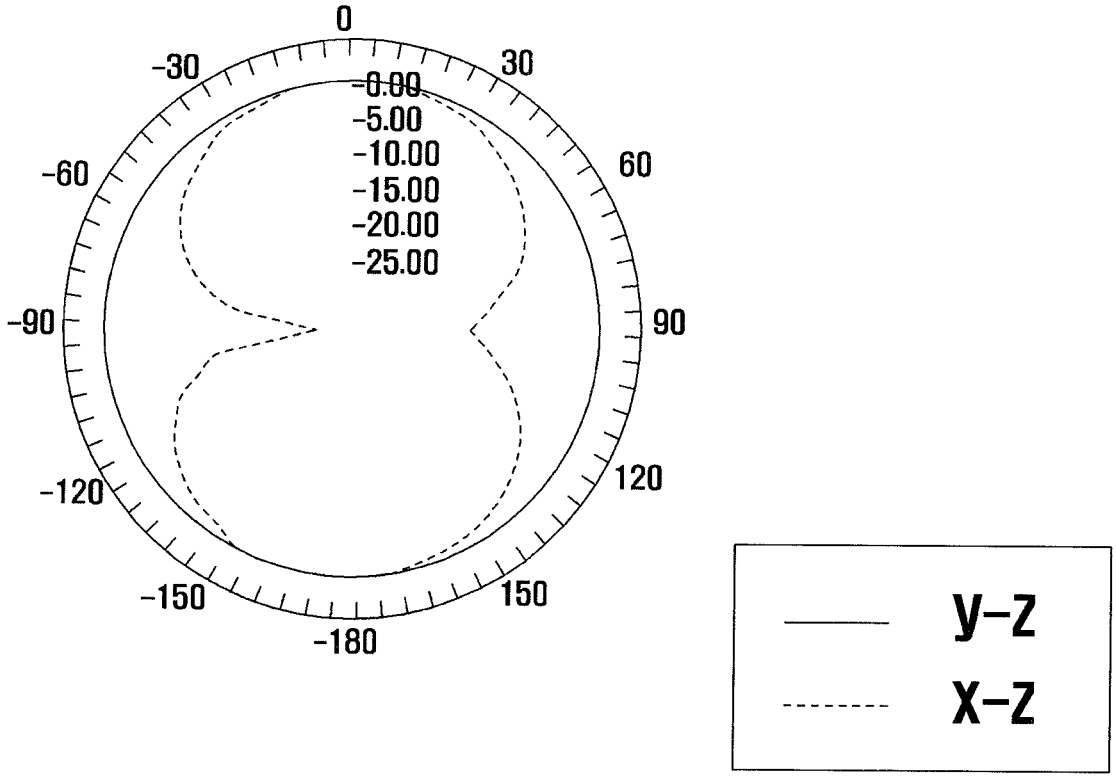
FIG. 9 depicts the radiation pattern of the antenna device of FIG. 6 during resonance.
Figure 10:
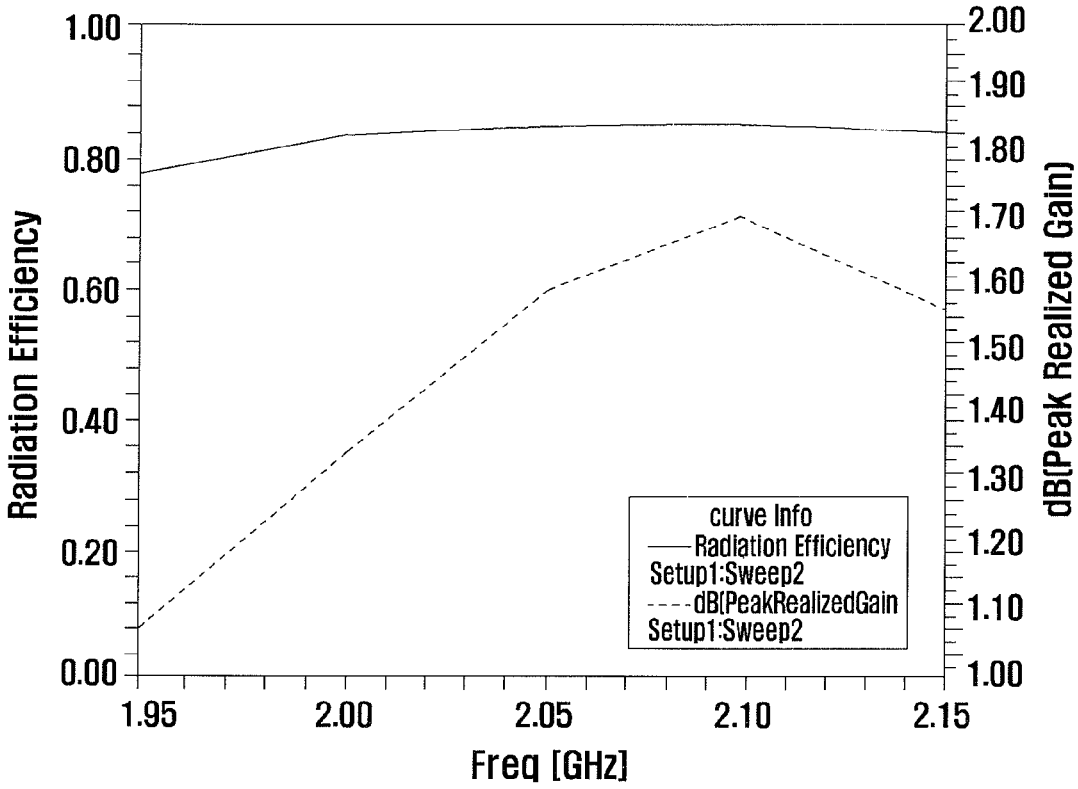
FIG. 10 depicts the operating efficiency and gain of the antenna device of FIG. 6 during resonance.

Next, operating characteristics of the infinite wavelength antenna device 400 are described. FIG. 8 depicts resonance characteristics of the device 400 of FIG. 6; FIG. 9 depicts the radiation pattern of the device 400 during resonance; and FIG. 10 depicts the operating efficiency and gain of the device 400 during resonance. Measurement results are based on the infinite wavelength antenna device 400 in which the board body 410 has a size given by an upper surface area (or lower surface area) of 10 mm×10 mm and a width of 1.6 mm. Here, in the infinite wavelength antenna device 400, the ENG resonance part 430 and the MNG resonance part 440 are designed to respectively resonate at a frequency band of 1.92 GHz to 1.98 GHz and another frequency band of 2.11 GHz to 2.17 GHz corresponding to the wideband code division multiple access (WCDMA) band. As shown in FIG. 8, the infinite wavelength antenna device 400 resonates at multiple frequency bands. That is, when power is supplied by the feed part 420, the ENG resonance part 430 resonates at a first frequency band (m1) and the MNG resonance part 440 resonates at a second frequency band (m2). Specifically, the ENG resonance part 430 may resonate at about 1.87 GHz and the MNG resonance part 440 may resonate at about 2.20 GHz. In other words, the infinite wavelength antenna device 400 has a 10 dB fractional bandwidth wider than the WCDMA band.

As shown in FIG. 9, the infinite wavelength antenna device 400 exhibits an omnidirectional radiation pattern. That is, the infinite wavelength antenna device 400 has directivity in angle but has non-directivity in azimuth. In other words, the infinite wavelength antenna device 400 may transmit and receive electromagnetic waves in all directions. As shown in FIG. 10, the infinite wavelength antenna device 400 achieves relatively high operating efficiency and gain. Specifically, the infinite wavelength antenna device 400 achieves operating efficiency of about 80% in the WCDMA frequency band, and achieves a gain of about 1 dBi to 1.7 dBi.

Figure 11:
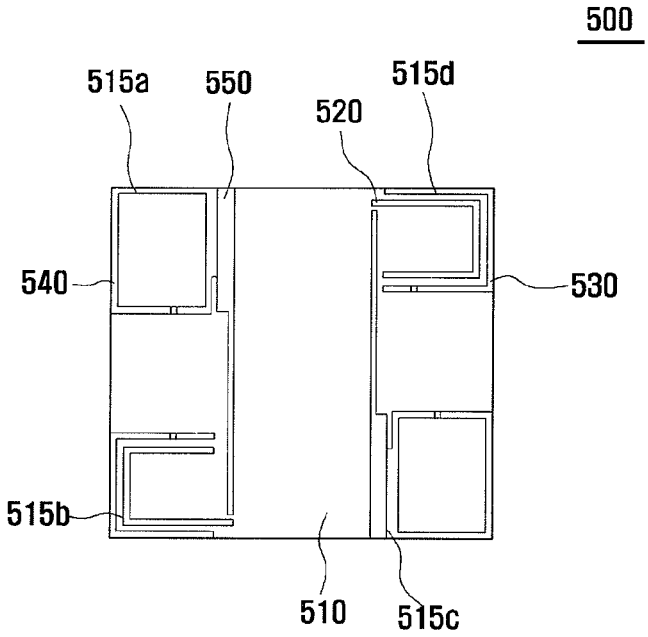
FIG. 11 is a top view of an infinite wavelength antenna device according to a fifth embodiment of the present invention.

In the previous embodiment, the infinite wavelength antenna device includes a single combination of the feed part, ENG resonance part, MNG resonance part and ground part. However, the present invention is not limited thereto. That is, the infinite wavelength antenna device may be realized using multiple combinations of the feed part, ENG resonance part, MNG resonance part and ground part. This is described as another embodiment. FIG. 11 is a top view of an infinite wavelength antenna device 500 according to a fifth embodiment of the present invention. Here, the infinite wavelength antenna device is assumed to be realized using a printed circuit board.

Referring to FIG. 11, the infinite wavelength antenna device 500 includes a board body 510 and first to fourth antenna elements 515*a*, 515*b*, 515*c* and 515*d*. Each of the first to fourth antenna elements 515*a*, 515*b*, 515*c* and 515*d* includes a feed part 520, an ENG resonance part 530, an MNG resonance part 540, and a ground part 550. The basic configuration of the infinite wavelength antenna device 500 is similar to that of the previous embodiment, and a detailed description thereof is thus omitted.

In the infinite wavelength antenna device 500, the first to fourth antenna elements 515*a*, 515*b*, 515*c* and 515*d* may be separately arranged at four corners of the board body 510 in a 2×2 configuration. The first to fourth antenna elements 515*a*, 515*b*, 515*c* and 515*d* are independently configured for isolation from each other. To achieve this, the upper surface and lower surface of the board body 510 may be different for the first and third antenna elements 515*a* and 515*c* and the second and fourth antenna elements 515*b* and 515*d*.

The maximum gain may be obtained by adjusting the phase condition of the infinite wavelength antenna device 500. Specifically, to identify the phase condition resulting in the maximum gain, the powers of the first to fourth antenna elements 515*a*, 515*b*, 515*c* and 515*d* are respectively set to 1 W, 1 W, 0 W and 0 W, and then the phase between the first and second antenna elements 515*a* and 515*b* is adjusted. Here, when the phase difference between the first and second antenna elements 515*a* and 515*b* is, for example, 180°, the maximum gain may be obtained. Next, the powers of the first to fourth antenna elements 515*a*, 515*b*, 515*c* and 515*d* are respectively set to 1 W, 1 W, 1 W and 1 W, and the phase difference between the first and second antenna elements 515*a* and 515*b* is determined also as the phase difference between the third and fourth antenna elements 515*c* and 515*d*. Then, the phase condition for the maximum gain may be obtained by setting the phase difference between the first and second antenna elements 515*a* and 515*b* and the phase difference between the third and fourth antenna elements 515*c* and 515*d* respectively to 0°, 10°, 20°, . . . .

Figure 12:
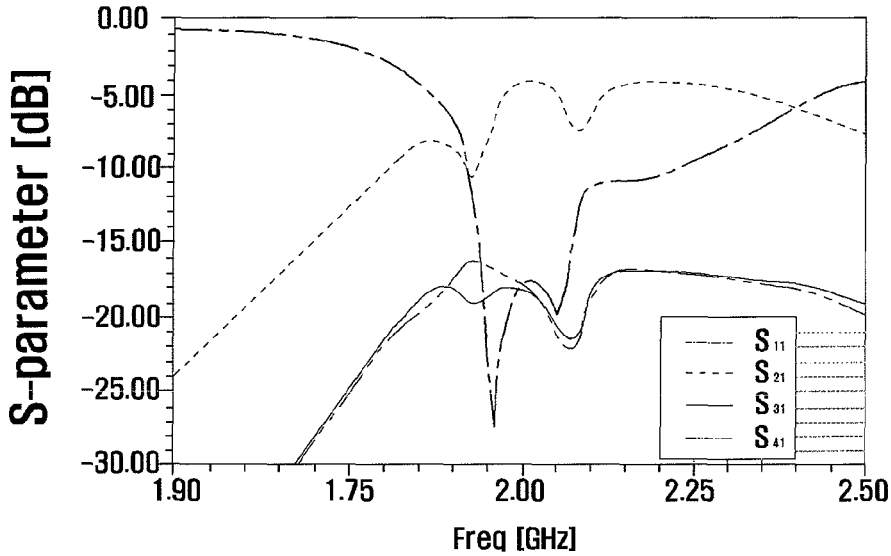
FIG. 12 depicts resonance characteristics of antenna elements in the device of FIG. 11.
Figure 13:
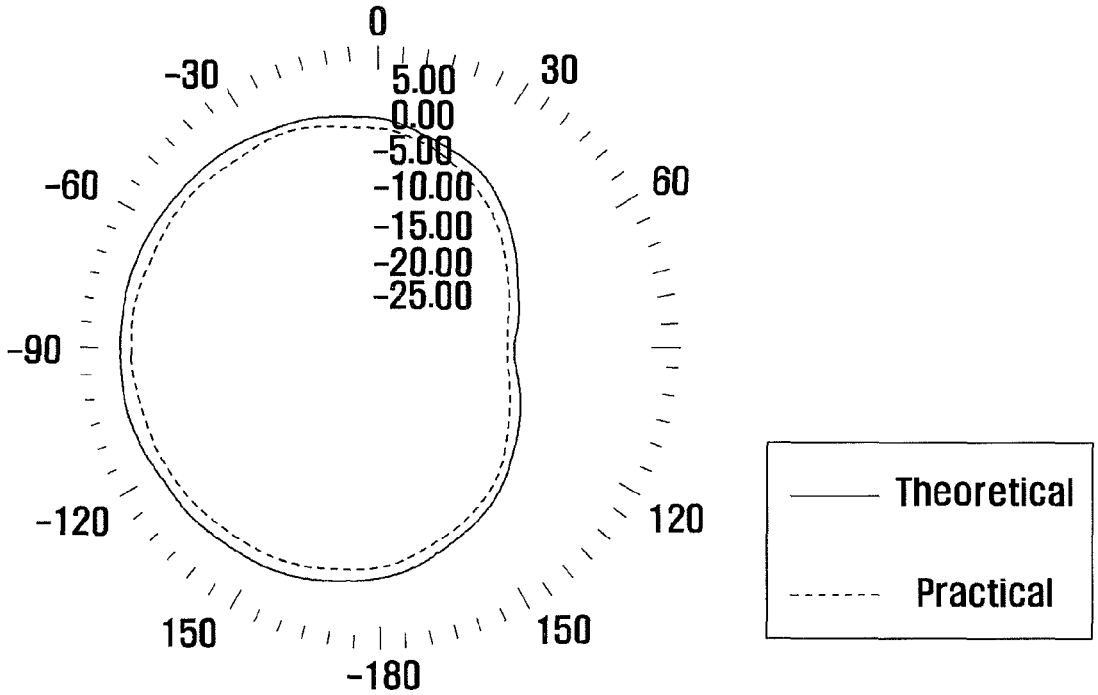
FIG. 13 depicts the radiation pattern of the antenna device of FIG. 11 during resonance.
Figure 14:
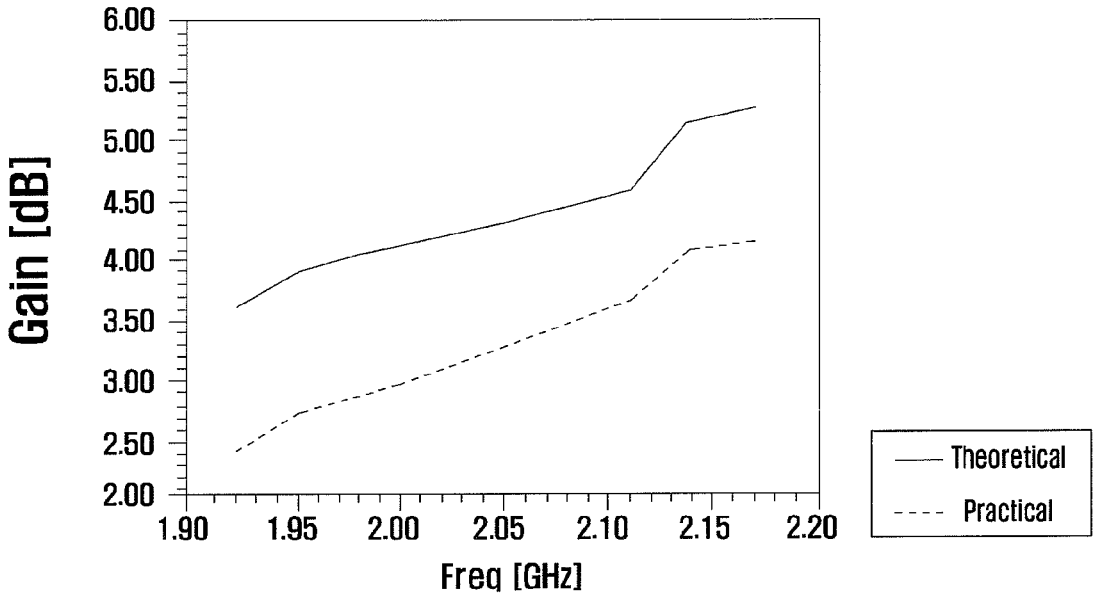
FIG. 14 depicts the gain of the antenna device of FIG. 11 during resonance.

Next, operating characteristics of the infinite wavelength antenna device 500 are described. FIG. 12 depicts resonance characteristics of the antenna element in FIG. 11; FIG. 13 depicts the radiation pattern of the device 500 during resonance; and FIG. 14 depicts the gain of the device 500 during resonance. Measurement results are based on the infinite wavelength antenna device 500, where the board body 410 has a size given by an upper surface area (or lower surface area) of 40 mm×40 mm and a width of 0.8 mm. Here, in the infinite wavelength antenna device 500, the ENG resonance part 530 and the MNG resonance part 540 are designed to respectively resonate at a frequency 1.92 GHz and another frequency of 2.08 GHz corresponding to the wideband code division multiple access (WCDMA) band.

As shown in FIG. 12, the infinite wavelength antenna device 500 resonates at multiple frequency bands. Here, $S_{11}$ is an S parameter indicating changes in the first antenna element 515*a*, $S_{21}$ is an S parameter indicating interference caused by the second antenna element 515*b* on the first antenna element 515*a*, $S_{31}$ is an S parameter indicating interference caused by the third antenna element 515*c* on the first antenna element 515*a*, and $S_{41}$ is an S parameter indicating interference caused by the fourth antenna element 515*d* on the first antenna element 515*a*. For example, as the ENG resonance part 430 resonates at frequencies of about 1.92 Ghz to 1.98 Ghz and the MNG resonance part resonates at frequencies of about 2.11 Ghz to 2.17 Ghz, the infinite wavelength antenna device 500 may resonate at frequencies of about 1.92 GHz to 2.25 GHz. In other words, the infinite wavelength antenna device 500 has a 10 dB fractional bandwidth wider than the WCDMA band.

As shown in FIG. 13, the infinite wavelength antenna device 500 exhibits a unidirectional radiation pattern. That is, the infinite wavelength antenna device 500 has directivity in angle and azimuth. In other words, the infinite wavelength antenna device 500 may transmit and receive electromagnetic waves in a particular direction. Hence, the infinite wavelength antenna device 500 may be used for beam forming As shown in FIG. 14, the infinite wavelength antenna device 500 achieves relatively high gain. Specifically, the infinite wavelength antenna device 500 achieves a theoretical gain of about 3.6 dBi to 5.2 dBi without consideration of loss and achieves a practical gain of about 2.4 dBi to 4.2 dBi in consideration of loss.

Figure 15:
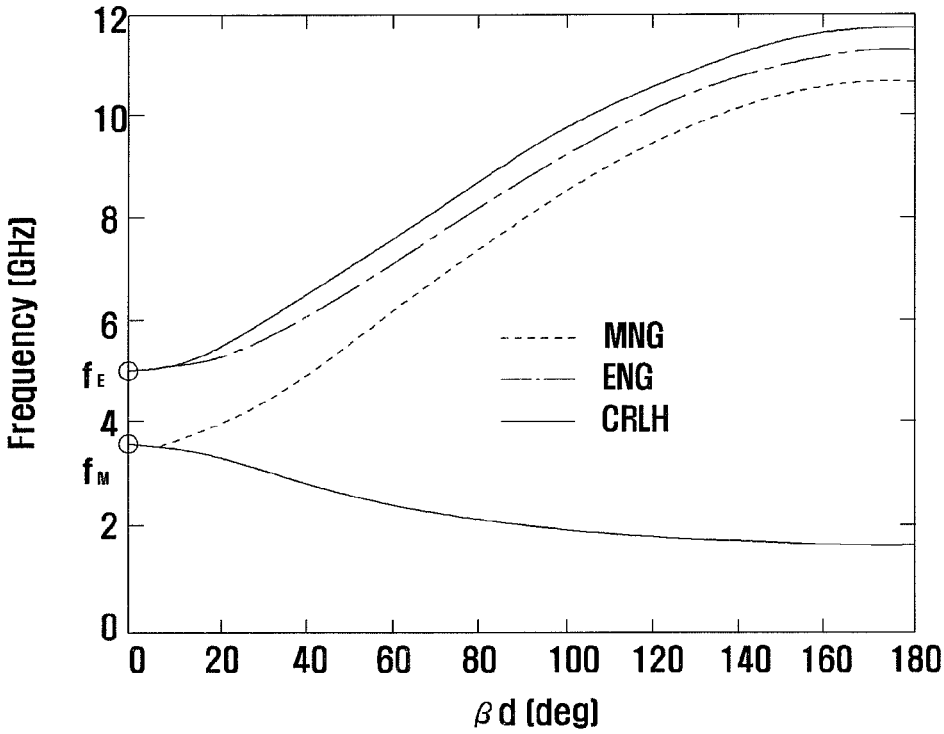
FIG. 15 is a diagram depicting dispersion characteristics of the ENG resonance part and MNG resonance part with respect to frequency bands.

In the above-described embodiments, a first resonant frequency band and a second resonant frequency band may be respectively determined independently of the sizes of the ENG resonance part and the MNG resonance part. This is described in connection with FIG. 15. FIG. 15 is a diagram depicting dispersion characteristics of the ENG resonance part and MNG resonance part with respect to frequency bands.

As shown in FIG. 15, the dispersion relations of an existing CRLH resonance part and the ENG resonance part and MNG resonance part of the present invention may be obtained by applying periodic boundary conditions to their equivalent circuits.

The dispersions of the CRLH resonance part, the ENG resonance part and the MNG resonance part are determined by Equation 7. The resonance mode (n) for the CRLH resonance part, the ENG resonance part and the MNG resonance part is determined by Equation 8.

$$\beta_{MNG}d = \cos^{-1}\left\{1 - \frac{1}{2}\left(\frac{w^2 - w_M^2}{w_R^2}\right)\right\},$$

$$\beta_{ENG}d = \cos^{-1}\left\{1 - \frac{1}{2}\left(\frac{w^2 - w_E^2}{w_R^2}\right)\right\},$$

$$\beta_{DNG}d = \cos^{-1}\left\{1 - \frac{1}{2}\left[\frac{w_L^2}{w^2} + \frac{w^2}{w_R^2} - \left(\frac{w^2 - w_M^2}{w_R^2}\right)\right]\right\},$$

where $$w_R = \frac{1}{\sqrt{L_R C_R}},\ w_L = \frac{1}{\sqrt{L_L C_L}},$$

$$w_E = \frac{1}{\sqrt{L_L C_R}},\ w_M = \frac{1}{\sqrt{L_R C_L}},$$

<Equation 7> where β indicates the phase constant and d indicates the size of a unit cell.

$$\beta_n d = \frac{n\pi d}{l} = \frac{n\pi}{N},$$

$$\begin{cases} MNG, ENG: n = 0, 1, 2, \ldots, (N-1) \\ CRLH: n = 0, \pm 1, \pm 2, \ldots, \pm(N-1), \end{cases}$$

<Equation 8> where N indicates the number of unit cells and l indicates the total length.

According to the present invention, like the CRLH resonance part, resonant frequency bands for the ENG resonance part and the MNG resonance part may be determined independently of the sizes of the ENG resonance part and the MNG resonance part. In other words, as the infinite wavelength antenna device of the present invention operates according to the infinite wavelength property, the resonant frequency band may be determined independently of the size of the infinite wavelength antenna device. Hence, miniaturization of the infinite wavelength antenna device can be realized.

In addition, as power feeding is performed using magnetic coupling in the infinite wavelength antenna device, power can be easily fed to multiple resonance parts of the infinite wavelength antenna device. Consequently, the infinite wavelength antenna device may resonate at multiple frequency bands or a wider frequency band.

While this invention has been described with reference to exemplary embodiments thereof, it will be clear to those of ordinary skill in the art to which the invention pertains that various modifications may be made to the described embodiments without departing from the spirit and scope of the invention as defined in the appended claims and their equivalents.

The invention claimed is:

1. An infinite wavelength antenna device comprising:

a board body made of a dielectric and having a slab structure;

a feed part arranged on one surface of the board body, and generating a magnetic field when power is applied; and a mu negative (MNG) resonance part arranged on the board body so that a preset distance is maintained from the feed part and at least a portion thereof is placed within the magnetic field, grounded through both ends thereof, resonating at a specific frequency band when the magnetic field is generated, and having a negative permeability.

2. The infinite wavelength antenna device of claim 1, wherein the MNG resonance part is a transmission line in which a transmission gap of a given size is formed.

3. The infinite wavelength antenna device of claim 2, wherein the feed part is formed as a bar extending in one direction, and wherein the MNG resonance part extends at one side of the feed part along the feed part in the extension direction.

4. The infinite wavelength antenna device of claim 2, further comprising a second MNG resonance part arranged so that a preset distance is maintained from the MNG resonance part, and resonating, when the magnetic field is generated, at another frequency band.

5. The infinite wavelength antenna device of claim 1, further comprising an epsilon negative (ENG) resonance part arranged on the board body so that a preset distance is maintained from the feed part and from the MNG resonance part and at least a portion thereof is placed within the magnetic field, grounded through one end thereof and open through the other end, resonating at a different frequency band when the magnetic field is generated, and having a negative permittivity.

6. The infinite wavelength antenna device of claim 5, wherein the ENG resonance part is a transmission line in which a transmission gap of a given size is formed.

7. The infinite wavelength antenna device of claim 5, wherein the feed part and the ENG resonance part are arranged on one surface of the board body and the MNG resonance part is arranged on the other surface of the board body.

8. An infinite wavelength antenna device comprising:

a board body made of a dielectric and having a slab structure;

a feed part formed as a bar extending in one direction on the upper surface of the board body, and generating a magnetic field when power is applied thereto;

a mu negative (MNG) resonance part arranged on the upper surface of the board body so that a preset distance is maintained from the feed part and at least a portion thereof is placed within the magnetic field, having a transmission line in which a transmission gap of a given size is formed, having a transmission via formed at each of both ends of the transmission line and passing through the board body to extend from the upper surface thereof to the lower surface thereof, resonating at a specific frequency band when the magnetic field is generated, and having a negative permeability; and a ground part formed on the lower surface of the board body, connected with the transmission via, and grounding the MNG resonance part through the transmission via.

9. The infinite wavelength antenna device of claim 8, wherein the MNG resonance part is composed of multiple MNG resonance regions each of which is identified by one transmission gap and a fixed-length transmission line, and wherein the MNG resonance regions are connected in series so as to extend from one side of the feed part along the extension direction of the feed part.

10. The infinite wavelength antenna device of claim 8, further comprising a second MNG resonance part arranged so that a preset distance is maintained from the MNG resonance part, and resonating, when the magnetic field is generated, at another frequency band.

11. The infinite wavelength antenna device of claim 8, wherein the transmission line is configured to have at least one bent portion and has at least one of a meander type, a spiral type, a step type and a loop type.

12. An infinite wavelength antenna device comprising:

a board body made of a dielectric and having a slab structure;

a feed part arranged on the upper surface of the board body, and generating a magnetic field when power is applied thereto;

an epsilon negative (ENG) resonance part arranged on the upper surface of the board body so that a preset distance is maintained from the feed part and at least a portion thereof is placed within the magnetic field, resonating at a first frequency band when the magnetic field is generated, and having a negative permittivity;

a mu negative (MNG) resonance part arranged on the lower surface of the board body so that a preset distance is maintained from the feed part and at least a portion thereof is placed within the magnetic field, resonating at a second frequency band different from the first frequency band when the magnetic field is generated, and having a negative permeability; and a ground part formed at one side of the MNG resonance part on the lower surface of the board body, and connected with one end of the feed part and one end of the ENG resonance part and further connected with both ends of the MNG resonance part to ground the feed part, the ENG resonance part and the MNG resonance part.

13. The infinite wavelength antenna device of claim 12, wherein each of the ENG resonance part and the MNG resonance part is a transmission line in which a transmission gap of a given size is formed.

14. The infinite wavelength antenna device of claim 12, wherein each of the feed part and the MNG resonance part comprises a transmission via passing through the board body at the one end and extending to the ground part.

15. The infinite wavelength antenna device of claim 13, wherein the transmission line is configured to have at least one bent portion and has at least one of a meander type, a spiral type, a step type and a loop type.

* * * * *